US005378130A

United States Patent [19]

Ozeki et al.

[11] Patent Number: 5,378,130

[45] Date of Patent: Jan. 3, 1995

[54] TANDEM TYPE GEAR PUMP HAVING AN INTEGRAL INNER MIDDLE PARTITION WALL

[75] Inventors: Tadasi Ozeki, Fusimi; Shigekazu Kitano, Kusatsu; Kyoji Sera, Joyo, all of Japan

[73] Assignee: Shimadzu Corporation, Kyoto, Japan

[21] Appl. No.: 34,127

[22] Filed: Mar. 18, 1993

[30] Foreign Application Priority Data

Mar. 31, 1992 [JP] Japan ..... 4-018740[U]

[51] Int. Cl.[6] ..... F04C 2/18; F04C 11/00; F04C 15/00

[52] U.S. Cl. ..... 418/102; 418/132; 418/200

[58] Field of Search ..... 418/200, 102, 132

[56] References Cited

U.S. PATENT DOCUMENTS

| | | | |
|---|---|---|---|
| 2,533,320 | 12/1950 | Hull et al. | 418/200 |
| 2,931,302 | 4/1960 | Dlugos | 418/200 |
| 2,965,036 | 12/1960 | Wood | 418/200 |
| 3,041,974 | 7/1962 | Judkins | 418/200 |
| 3,472,023 | 10/1969 | Gimmler | 418/200 |
| 3,909,165 | 9/1975 | Laumont | 418/102 |
| 4,259,045 | 3/1981 | Teruyama | 418/200 |

FOREIGN PATENT DOCUMENTS

| | | | |
|---|---|---|---|
| 57-8390 | 1/1982 | Japan . | |
| 57-52695 | 3/1982 | Japan | 418/200 |

*Primary Examiner*—John J. Vrablik

*Attorney, Agent, or Firm*—Banner, Birch, McKie & Beckett

[57] ABSTRACT

In a tandem type gear pump, the housing body has an inner middle partition wall portion integral with the body and having bearing means. The housing body is formed at the opposite axial end faces thereof with a pair of recesses each shaped like a pair of glasses, with a pair of covers being fixed to the axial end faces of the body to close the recesses. A pair of gear pump units are set in the recesses so as to be rotatable by the bearing means in synchronism with each other. The housing is provided with inlet and outlet port means in communication with the gear pump units.

1 Claim, 3 Drawing Sheets

TANDEM TYPE GEAR PUMP HAVING AN INTEGRAL INNER MIDDLE PARTITION WALL

BACKGROUND OF THE INVENTION

This invention relates generally to a tandem type gear pump which can be effectively used in various fields of use of hydraulic machines and instruments.

The tandem type gear pump generally comprises a plurality of pump units so combined as to be driven by a common drive and is useful in case different operating pressures are used simultaneously, in case one after another operating pressure is used, or in case two or more kinds of operating fluid are used.

Japanese Unexamined Utility Model Publication No. 57-8390 or 57-10493 discloses a tandem type gear pump which comprises a housing formed with bores shaped like a pair of glasses, in which three sets of bearing members are axially arranged with a pair of front and rear gear pump units interposed between each adjacent two of the bearing members. Each of the front and rear gear pump units has a drive shaft with a drive gear fixed thereto and a driven shaft with a driven gear fixed thereto and meshing with the drive gear. The drive shafts of the two pump units are connected by a coupling within the intermediate bearing member. When the drive shafts are rotated simultaneously by a drive, each of the pump units individually draws in hydraulic fluid through its inlet port and discharges the fluid through its outlet port.

In the prior art arrangement, the housing in which the bores shaped like a pair of glasses are formed is a body separate from the body in which the bearing bores are formed, so that the positioning of the bores in the separate bodies must be adjusted in separate machining processes. As a result, the relative positions of the bores are likely to be misaligned due to errors in machining or assembly, and gaps are formed between the bores and the outer peripheries of the gears thereby to reduce the volumetric efficiency of the pump. Since the housing and the bearings are separate individual objects, hydraulic fluid is likely to leak out through the gaps therebetween thereby to reduce the volumetric efficiency of the pump. Moreover, if vibration of the bearings acts as an alternating load, fretting corrosion is likely to occur in the bores to increase leakage of hydraulic fluid.

Accordingly, the primary object of the invention is to solve the above problems encountered in the prior art and provide a tandem type gear pump in which the number of machining and assembling steps can be reduced.

SUMMARY OF THE INVENTION

The tandem type gear pump constructed in accordance with the invention comprises a housing body including an inner middle partition wall portion integral with the body and formed with a pair of parallel, axial through bearing bores. The housing body is formed at the opposite axial end faces thereof with a pair of recesses each shaped like a pair of glasses, in which a pair of gear pump units are set one in each of the recesses for simultaneous rotation, with a separate outlet port being provided in communication with each of the pump units. The provision of separate outlet ports makes the gear pump of the invention distinct from a phase difference pump.

In accordance with the invention, it is possible to form both the recesses shaped like a pair of glasses and the bearing bores by machining at the same time in the housing body held stationary thereby to eliminate errors in forming the recesses and bores and assembling the component parts of the pump units, with resulting improvement of the accuracy and precision of assembly of the gears in the pump housing. Since the middle partition wall portion corresponding to the side plates in the prior art is made integral with the housing body, there will be produced no gap which would otherwise cause leakage of operating fluid or fretting corrosion to occur.

PREFERRED EMBODIMENTS OF THE INVENTION

Figure 1:
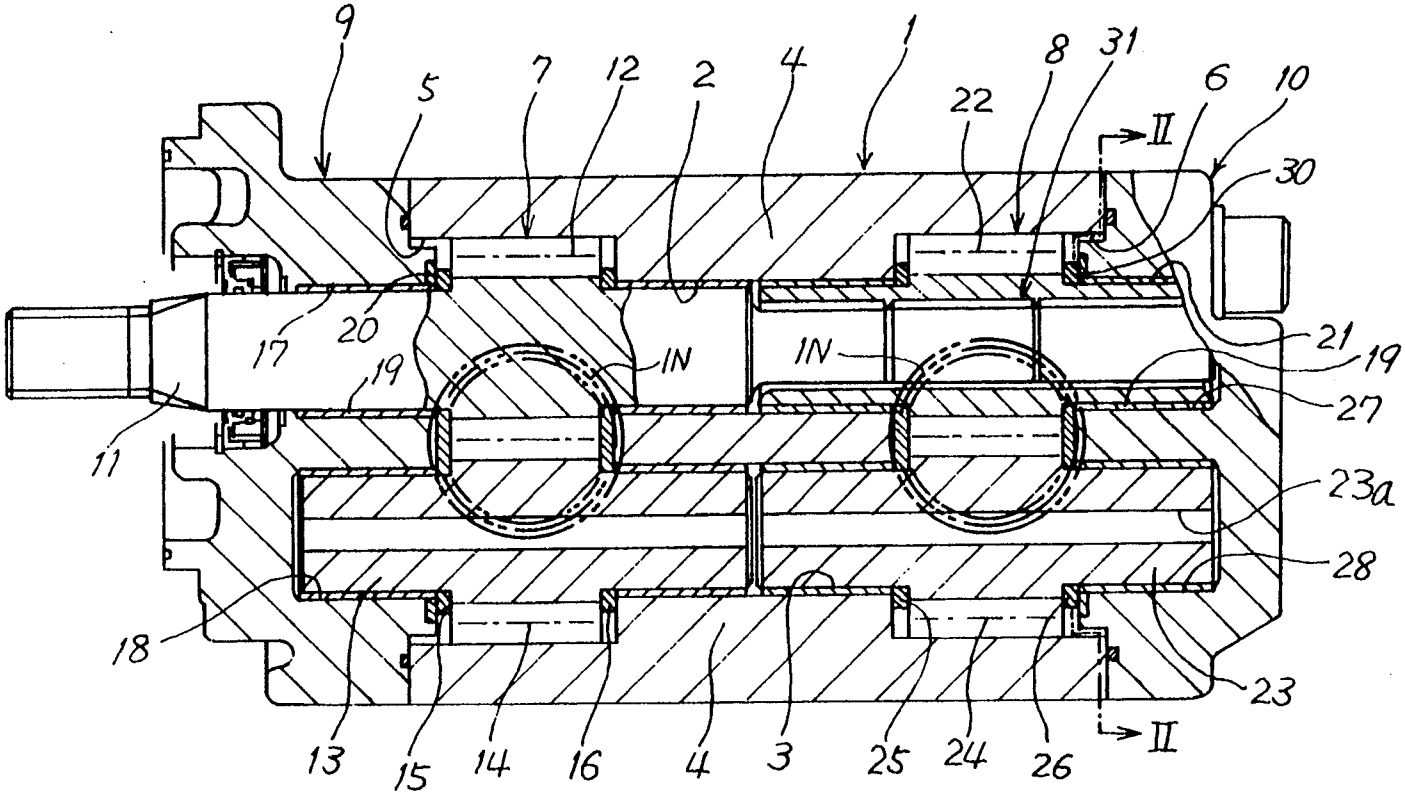
FIG. 1 is a partially cross-sectioned view illustrating internal part of the tandem pump.

Referring now to the drawings, first to FIGS. 1 to 4 showing a tandem type gear pump constructed in accordance with the invention, there is shown a pump housing A which comprises a body 1 having an inner middle partition wall portion 4 integral with the body and formed with a pair of bearing bores 2 and 3 extending axially therethrough and in parallel with each other. The body 1 is formed at the opposite axial end faces thereof with a pair of recesses 5 and 6 each shaped like a pair of glasses. A pair of front and rear gear pump units 7 and 8 are set in the recesses 5 and 6, respectively, with a front and a rear cover 9 and 10 being fluid-tightly secured to the opposite axial ends of the body 1 to close the recesses 5 and 6.

The front cover 9 is formed with a pair of bearing bores 17 and 18, and the rear cover 10 is formed with a pair of bearing bores 27 and 28. The bearing bores 27 and 28 are axially aligned with the bearing bores 2 and 3 formed in the middle partition wall portion 4 of the body 1 of the housing.

The front gear pump unit 7 comprises a drive shaft 11, a drive gear 12 fixed thereto for simultaneous rotation therewith. a driven shaft 13 and a driven gear 14 fixed thereto for simultaneous rotation therewith and meshing with the drive gear 12. The drive and driven shafts 11 and 13 are journalled in the bearing bores 2 and 3 in the middle partition wall portion 4 of the housing body 1 and the bearing bores 17 and 18 in the front cover 9 by means of bushings 19, respectively, with a pair of side plates 15 and 16 being provided in sliding contact with the opposite axial end surfaces of the gears 12 and 14 thereby to prevent wear in the sliding surfaces and define an enclosure in which a pressure is generated. A gasket 20 shaped like the numeral 3 (three) is provided at the inner side of the front cover 9, so that a pressure generated in a groove containing the gasket 20 balances the pump pressure on the front side plate 15.

The rear gear pump unit 8 comprises a drive shaft 21, a drive gear 22 fixed thereto for simultaneous rotation therewith, driven shaft 23 and a driven gear 24 fixed thereto for simultaneous rotation therewith and meshing with the drive gear 22. The drive and driven shafts 21 and 23 are journalled in the bearing bores 2 and 3 in the middle partition wall portion 4 of the housing body 1 and the bearing bores 27 and 28 in the rear cover 10 by means of bushings 19, respectively, with a pair of side plates 25 and 26 being provided in sliding contact with the opposite axial end surfaces of the gears 22 and 24 thereby to prevent wear in the sliding surfaces and define an enclosure which a pressure is generated. A gasket 30 shaped like the numeral 3 (three) is provided at the inner side of the rear cover 10, so that a pressure in a groove containing the gasket 30 balances the pump pressure on the rear side plate 26. The drive shafts 11 and 21 are connected through a spline 31 so as to be rotatable simultaneously.

Figure 3:
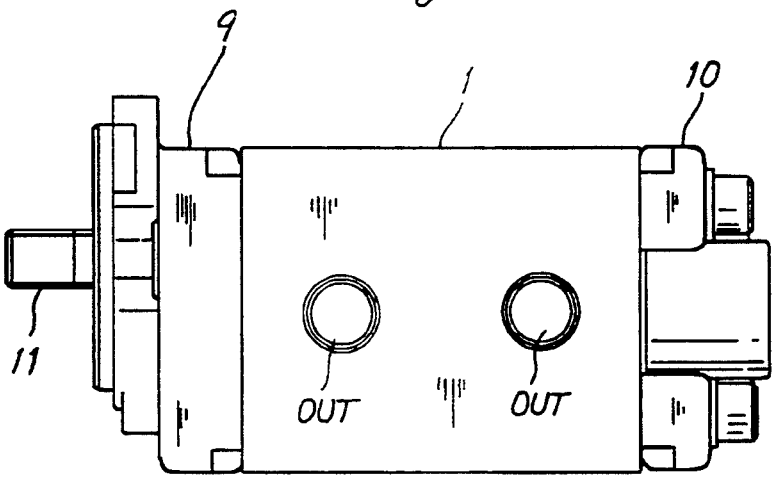
FIG. 3 is an elevational view of one embodiment of the invention.
Figure 4:
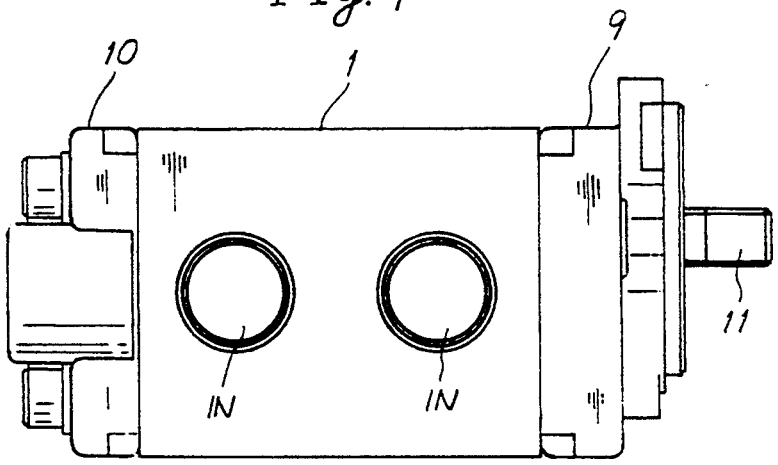
FIG. 4 is a rear view of FIG. 3.

As shown in FIGS. 3 and 4, each of the gear pump units 7 and 8 has an inlet port IN and an outlet port OUT.

The oil that leaks from the drive gears 12 and 22 at the sides thereof facing the middle partition wall portion 4 of the housing body 1 is forced to lubricate the spline 31 so as to be returned through the rear cover 10 into the inlet port IN. The oil that leaks from the driven gears 14 and 24 at the sides thereof facing the middle partition wall portion 4 is passed through an axial through bore 23*a* formed in the driven shaft 23 to be returned through the rear cover 10 into the inlet port IN.

Figure 2:
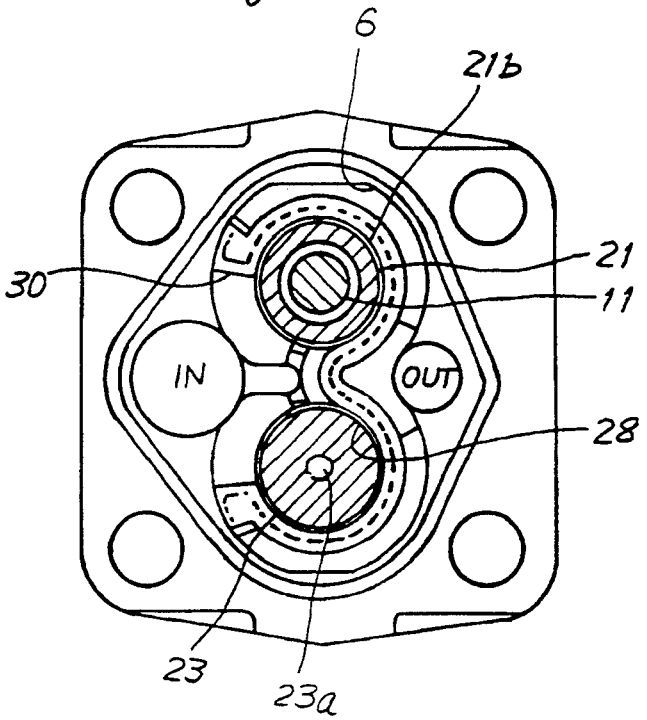
FIG. 2 is a cross-section of FIG. 1, as generally indicated by arrows 2—2 in FIG. 1

In operation, suppose that the drive shaft 11 of the gear pump unit 7 is rotated clockwise in FIG. 2. The drive shaft 21 of the gear pump 8 is also rotated clockwise through the spline connection 31, so that hydraulic fluid is pumped out of the housing at the obverse side of the drawing sheet of FIG. 1, with hydraulic fluid being drawn in at the reverse side thereof. Since the two pump units 7 and 8 are separated by the middle partition wall portion 4 of the body 1 of the pump housing, the hydraulic oil that is drawn in through the respective inlet ports IN can be taken out separatey from the respective outlet ports OUT as shown in FIGS. 3 and 4. Therefore, the tandem type gear pump of the invention is suitable for use in applications wherein a plurality of degrees of operating pressure are handled, the operating pressure is changed stepwise, or two or more different kinds of operating hydraulic fluid are employed.

Since the middle partition wall portion 4 which corresponds to the intermediate bearing member in the prior art arrangements is integral with the body 1, it is possible to form the recesses 5 and 6 and the bearing bores 2 and 3 at the same time by machining, with the housing body 1 held stationary, thereby preventing misalignment of the bores 2, 3, 5 and 6 which would otherwise be caused by errors in machining or assembling the components of the pump, and enabling the gears 12, 14, 22 and 24 to be assembled in the recesses 5 and 6 with a high degree of accuracy and precision, with resulting improvement of the volumetric efficiency of the pump. Since in the arrangement of the invention the middle partition wall portion 4, which corresponds to the side plates of the gears in the prior art arrangements, is integral with the housing body 1, there is no gap and consequently no fretting corrosion which would cause or increase leakage as in the prior art arrangement, so that the volumetric efficiency of the pump is improved.

Figure 5:
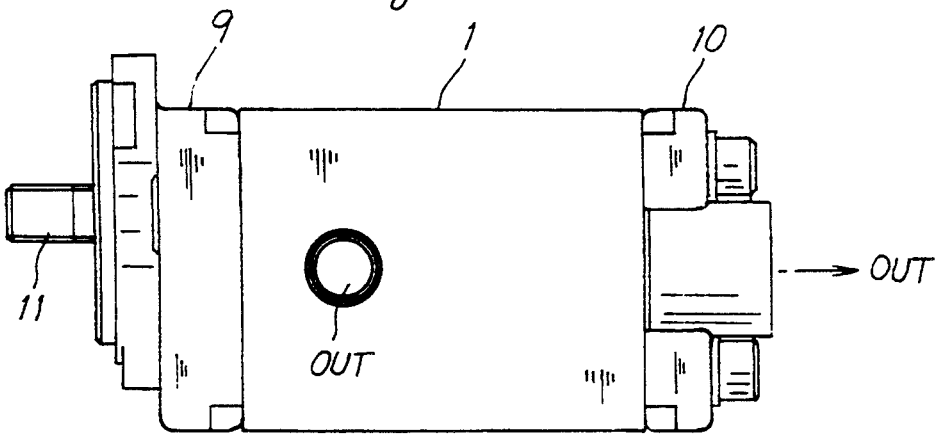
FIGS. 5 and 6 are elevational views illustrating other embodiments of the invention.

The positions of the inlet and outlet ports IN and OUT are not limited to those in the illustrated embodiment. For example, the hydraulic fluid from the gear pump 8 can be taken out not from the body 1 but through the rear cover 10 as in FIG. 5 showing the front view of the housing body 1.

Figure 6:
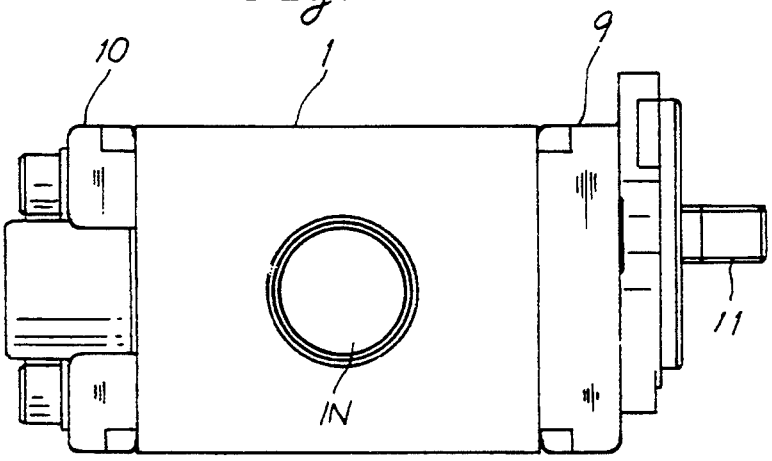

As shown in FIG. 6, the housing may be provided with a single common inlet port IN to which the respective inlet ports of the pump units are connected within the housing body 1. The inlet ports IN as shown in FIG. 4 or 6 and the outlet ports OUT as shown in FIG. 3 or 5 may be combined in various other manners.

In accordance with the invention, it is possible to improve accuracy and precision in forming the recesses shaped like a pair of glasses and the bearing bores in the housing body and assembling the gears and other component parts therein thereby to reduce interior leakage and increase the volumetric efficiency of the pump and consequently improve the performance thereof. It is also possible to reduce the number of component parts, the number of manufacturing steps and the cost involved.

Having described some preferred embodiments of the invention, the invention is not restricted to the illustrated embodiments but there may be various modifications and changes within the scope of the invention defined in the claims.

What we claim is:

1. A tandem type gear pump comprising:

a housing having a body and an inner middle partition wall portion integral with said body as one piece, said body being provided at opposite axial end faces thereof with a pair of recesses which are each shaped like a pair of glasses, and a pair of covers each attached to a corresponding one of said axial end faces of said body so as to close said recesses;

each said pair of gear pump units including a drive shaft with corresponding drive gear fixed thereto for simultaneous rotation with said drive gear, and a driven shaft with corresponding driven gear fixed thereto for simultaneous rotation with said driven gear and meshing simultaneous rotation with said drive gear, each said pair of gear pump units being set in one of said recesses so as to be rotatable in synchronism with the other of said pair of gear pump units;

bearing means for rotatably supporting said gear pump units and comprising, for each said pair of gear pump units, a middle pair of parallelly disposed bearing bores formed in and extending axially through said inner middle partition wall portion and an end pair of bearing bores formed in an adjacent one of said end covers so as to be axially aligned with said middle pair when assembled;

each said drive and driven shaft being journaled in said bearing means, a first of said drive shafts being attached to and simultaneously rotatable with a second of said drive shafts, with said first of said drive shafts having an externally splined portion telescopic within an internally splined portion of said second of said drive shafts;

inlet port means, of said gear pump units, for inputting fluid thereto and outlet port means, of said gear pump units, for outputting fluid therefrom; and at least one of said covers comprising:

means, in said cover, for redirecting fluid therethrough;

means for routing fluid leaking from said drive gears and passing said leaking fluid between and in lubricating contact with said splined portions and returning said leaking fluid to said inlet port via said redirecting means; and gasket means for providing sealing at an interface between at least one of said covers and said housing while facilitating said redirecting, said gasket means comprising a gasket shaped like a number 3 opening normal to longitudinal axes of said shafts, so as to cause said fluid being redirected by said cover to return to said inlet port means.

* * * * *